United States Patent [19]

Finch et al.

[11] Patent Number: 4,585,973

[45] Date of Patent: Apr. 29, 1986

[54] TRAVELLING WAVE OR LIKE TUBES

[75] Inventors: Ronald L. Finch, Chelmsford; Robert L. Wright, Coggeshall; Graham C. T. Ball, Marks Tey, all of England

[73] Assignee: English Electric Valve Company Limited, Chelmsford, England

[21] Appl. No.: 602,926

[22] Filed: Apr. 23, 1984

[30] Foreign Application Priority Data

Jan. 4, 1984 [GB] United Kingdom ..... 8400106

[51] Int. Cl.[4] ..... H01J 25/34

[52] U.S. Cl. ..... 315/3.5; 315/39.53; 333/26; 333/32

[58] Field of Search ..... 333/25, 26, 32, 34; 315/3.5, 39.53

[56] References Cited

U.S. PATENT DOCUMENTS

| | | | |
|---|---|---|---|
| 2,922,127 | 1/1960 | Dench | 333/34 |
| 3,448,331 | 6/1969 | Cook | 315/39.53 |
| 3,478,282 | 11/1969 | Smith | 333/34 X |
| 3,707,647 | 12/1972 | Rawls, Jr. | 315/39.53 |
| 4,138,625 | 2/1979 | Koyama et al. | 315/39.53 |
| 4,297,662 | 10/1981 | Gross et al. | 333/34 |
| 4,463,324 | 7/1984 | Rolfs | 333/26 |

*Primary Examiner*—Saxfield Chatmon
*Attorney, Agent, or Firm*—Spencer & Frank

[57] ABSTRACT

A travelling wave tube has an output lead passing through a tubular output arm to a cap provided at the end of the arm. The cap has a cylindrical wall of ceramic material and is completed by a flanged plate of metal, to which said output lead is attached. When coupled to a waveguide, the travelling wave tube output arm enters an entry hole in one wall of the waveguide while the cap thereof abuts a matching ridge provided on the interior of the opposite wall of the waveguide. A small recess in the ridge locates the cap, the cylindrical wall of which acts as a window through which travelling wave tube output may pass into the interior of said waveguide.

13 Claims, 2 Drawing Figures

TRAVELLING WAVE OR LIKE TUBES

BACKGROUND OF THE INVENTION

This invention relates to travelling wave or like tubes in which an output lead is required to provide input to a waveguide. In the case of a travelling wave tube having a delay line in the form of a helix, the said output lead is usually a lead attached to or formed as an extension of said helix.

A typical arrangement including a travelling wave tube as above mentioned is illustrated in FIG. 1 of the accompanying drawings.

Referring to FIG. 1 this shows in section the travelling wave tube 1 connected to provide input to a waveguide 2. The helix of the tube is referenced 3. The helix 3 is shown supported by support rods 4.

The end of the helix 3 is connected to an output lead 5 which extends into a tubular output arm 6, forming part of the main body of the travelling wave tube. Output lead 5 is connected to a stepped leadout 7 which extends into window section 8.

One end 9 of window section 8 fits inside the output arm 6, the two being fixed one to the other, in gas-tight fashion, by brazing or the like.

The other end 10 of window section 8, an enlarged end as may be seen, is closed by a ceramic window 11 having a centrally located hole 12 therein. Ceramic window 11 extends it will be noted, transversely to the longitudinal axis of window section 8, stepped leadout 7, output arm 6, and output lead 5. The outer portion of window 11 stands proud of the outer surface of the end 10 of window section 8.

The end 13 of the stepped output leadout 7 is reduced in order to receive one end of a tubular probe 14 forming part of an intermediate connection section 15 which is between the travelling wave tube proper and the waveguide 2.

Thus the travelling wave tube proper consists of all component parts and features referenced 1 to 13 inclusive, so that the output end of the tube comprises the window 11 set within the enlarged end 10 of window section 8, with the reduced end 13 of tapered leadout 7 ready to receive the end of tubular probe 14 through the hole 12 in the window 11.

Intermediate connection section 15 has one end 16 enlarged and shaped to receive the outer portion of ceramic window 11 standing proud of the end 10 of window section 8. End 10 is secured to the window 11 in gas tight fashion.

The other end 17 of the intermediate connection member 15 is formed as a flange by means of which the member 15 is secured to waveguide 2. This flange surrounds an entry hole 18 in the wall of waveguide 2, through which hole the aforementioned tubular probe 14 passes. The end of tubular probe 14 within waveguide 2 enters a ridge 19 provided on the wall of waveguide 2 opposite the wall thereof in which is provided entry hole 18. The ridge 19 provides for matching and includes match adjusting screws 20. Beyond the ridge 19 and almost immediately after the entry hole 18, waveguide 2 is closed by a short circuiting member 21.

The above described construction of travelling wave tube and travelling wave tube arrangement results in a number of disadvantages. For example the tube tends to be relatively fragile particularly in the region of the windows 11 and particularly when designed for higher frequencies. Furthermore the heat transference properties tend to be unsatisfactory.

SUMMARY OF THE INVENTION

One object of the present invention is to provide an improved travelling wave tube and travelling wave tube arrangement in which the above disadvantages are mitigated.

According to this invention an electronic tube having an output lead which is required to provide input to a waveguide is provided, said tube comprises a hollow output arm through which said output lead passes to an end cap provided at the end of said hollow output arm which end cap provides in the tubular wall thereof a window for communication with said waveguide and the arrangement being such that, when entered through an entry hole in one wall of said waveguide, said end cap abuts the inner surface of said waveguide opposite said entry hole.

Preferably said electronic tube is a travelling wave tube having a helix forming a slow wave structure and said output lead is connected to said helix.

Preferably from its pick-up point within said electronic tube to said cap, said output lead is in one continuous piece.

Preferably said window is cylindrical, surrounding said output lead.

Preferably said window forms the entire tubular wall of said cap.

Preferably said cap is completed by a plate extending across its tubular wall which plate is preferably flanged with the flange of said plate encompassing the end of said tubular wall.

Preferably said plate is of metal and said output lead is attached thereto (e.g. by brazing).

Normally said window material is ceramic as known per se.

When connected to a waveguide which is to receive input from said output lead of said electronic tube, preferably the output arm of said electronic tube is entered into an entry hole in one wall of said waveguide such that said window communicates wtih the interior of said waveguide.

Where, as will normally be the case, said waveguide has a matching ridge provided on the interior of the wall thereof opposite the wall wherein said entry hole is provided, said ridge provides said inner surface that said cap abuts.

Preferably said cap is received within a recess in said ridge.

Where said cap is completed by a flanged plate as described above, preferably the depth of the recess in said ridge approximates to the depth of the flange provided on said plate.

DESCRIPTION OF A PREFERRED EMBODIMENT

Figure 1:
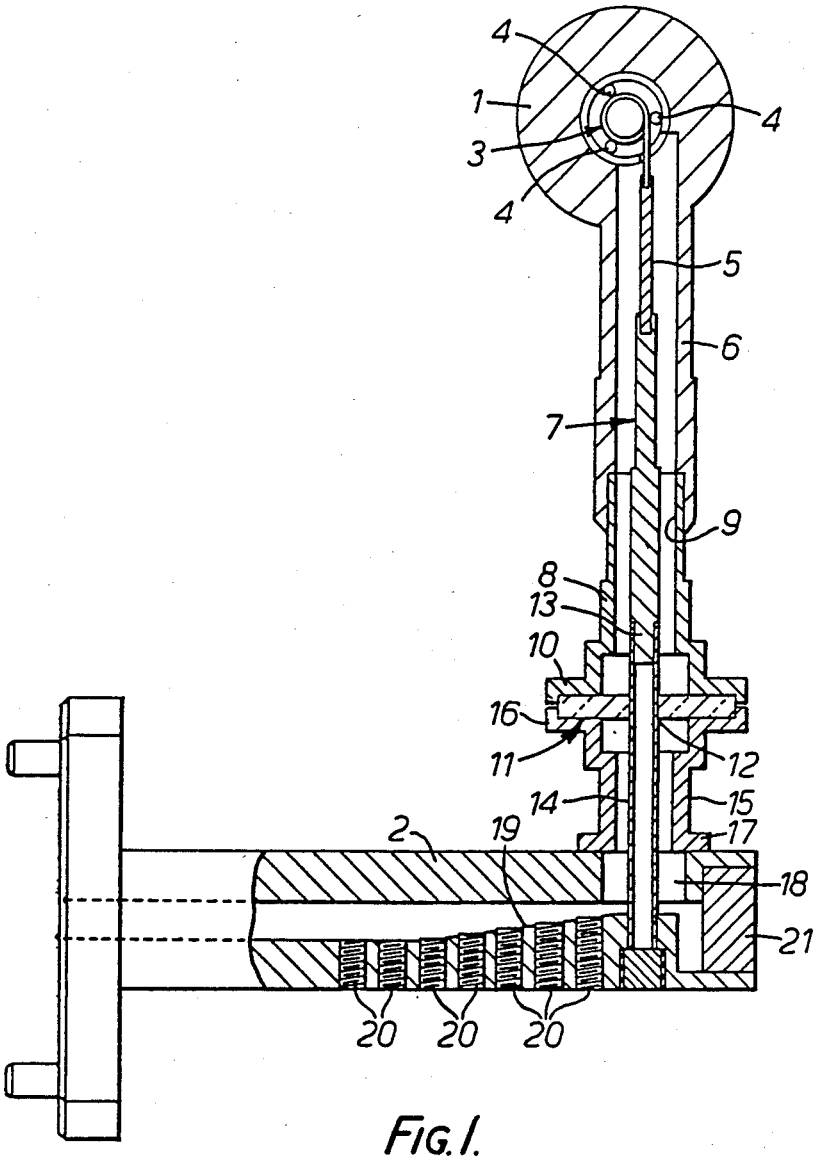
FIG. 1 is a sectional view which illustrates a typical arrangement for coupling an output lead of a travelling wave tube and a waveguide.
Figure 2:
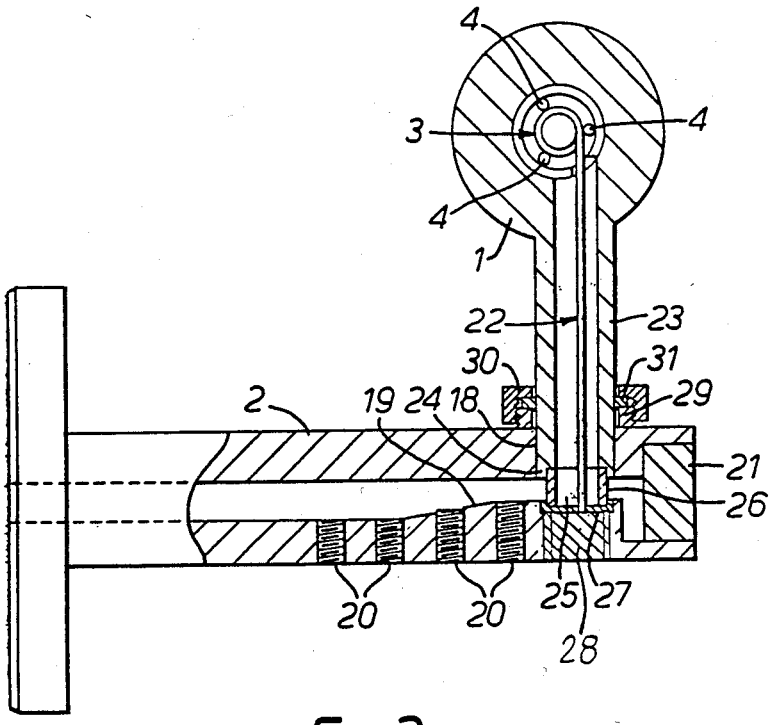
FIG. 2 is a sectional view which illustrates one example of travelling wave tube and travelling wave tube arrangement in accordance with the present invention.

The section chosen in the case of FIG. 2 corresponds to the section chosen in the case of FIG. 1, the more easily to enable comparisons to be made, and in FIGS. 1 and 2 like references are used to denote like parts.

Referring to FIG. 2, again the helix of the travelling wave tube and the helix support rods are referenced 3 and 4 respectively. Again an output lead 22 is connected to the end of helix 3 and output lead 22 extends into a tubular output arm 23. Output lead 22 and tubular output arm 23 differ from the corresponding lead 5 and output arm 6 of FIG. 1 in that, in the case of FIG. 2, the lead 22 is not connected to a stepped leadout (referenced 7 in FIG. 1) but in this example extends for the full length of and beyond the output arm 23 and the latter is not provided to receive a window section which in turn is connected to an intermediary connection section (referenced 8 and 15 in FIG. 1) but instead itself extends to enter entry hole 18 in the waveguide 2.

The end 24 of output arm 23 provided to enter entry hole 18 carries a cap 25. Cap 25 fits within a recess in end 24 of output arm 23 and has a cylindrical ceramic wall 26 closed by a flanged circular metal plate 27. When the end 24 of output arm 23, with cap 25 is passed through the entry hole 18 in waveguide 2, plate 27 locates in a shallow recess in the ridge 19, and cylindrical wall 26 act as a window through which the travelling wave tube output is passed into the waveguide 2. As will be seen, the depth of the recess in the ridge 19 approximates to the depth of the flange provided on plate 27.

The end of the output lead 22 extending beyond output arm 23 is connected to and terminates in metal plate 27. The metal plate 27 is in contact with a copper stud 28 set into the wall of the waveguide 2. The copper stud 28 is threaded so that the depth of its penetration into the waveguide can be adjusted, allowing it to be brought into firm thermal and electrical contact with the plate 27.

In order to secure the travelling wave tube 1 to waveguide 2, the latter has brazed thereon an externally threaded annular ring 29 surrounding entry hole 18 whilst tubular output arm 23 carries an internally threaded flanged ring 30 the flange of which encircles annular ring 29. Between rings 28 and 29 is a metal ring 31 brazed to the output arm 23.

It will be noted that the contact between the cap 25 and the ridge 19 tends to provide good heat transference to the wavguide 2. This permits the end cap to be efficiently cooled. A thin pad of soft, deformable metal can be placed between the outer face of the plate 27 and the recessed ridge 19.

What we claim is:

1. An electronic tube having an output lead which is required to provide input to a waveguide, said tube comprising a hollow output arm through which said output lead passes, and an end cap provided at the end of said hollow output arm and to which said output lead passes, said end cap including a tubular wall which provides a window for communication with said waveguide and a metal plate affixed to the tubular wall, and the arrangement being such that, when entered through an entry hole in one wall of said waveguide, said metal plate of said end cap abuts the inner surface of said waveguide opposite said entry hole.

2. An electronic tube as claimed in claim 1 and wherein said electronic tube is a travelling wave tube having a helix forming a slow wave structure and said output lead is connected to said helix.

3. An electronic tube as claimed in claim 1 and wherein from its pick-up point within said electronic tube to said cap, said output lead is in one continuous piece.

4. An electronic tube as claimed in claim 1 and wherein said window is cylindrical, surrounding said output lead.

5. An electronic tube as claimed in claim 4 and wherein said window forms the entire tubular wall of said cap.

6. An electronic tube as claimed in claim 5 and wherein said plate extends across the tubular wall of the cap.

7. An electronic tube as claimed in claim 6 and wherein said plate is flanged with the flange of said plate encompassing the end of said tubular wall.

8. An electronic tube as claimed in claim 5 and wherein said output lead is attached to said plate.

9. An arrangement of an electronic tube as claimed in claim 1 connected to a waveguide which is to receive input from said output lead of said electronic tube.

10. An arrangement as claimed in claim 9 wherein said waveguide has a matching ridge provided on the interior of the wall thereof opposite the wall wherein said entry hole is provided, whereby said ridge provides said inner surface that said cap abuts.

11. An arrangement as claimed in claim 10 and wherein said cap is received within a recess in said ridge.

12. An arrangement as claimed in claim 11 wherein said plate is flanged with the flange of said plate encompassing the end of said tubular wall and wherein the depth of the recess in said ridge approximates to the depth of the flange provided on said cap.

13. An electronic tube as claimed in claim 2 and wherein from its pick-up point within said electronic tube to said cap, said output lead is in one continuous piece.

* * * * *